US009464487B1

(12) United States Patent
Zurn

(10) Patent No.: US 9,464,487 B1
(45) Date of Patent: Oct. 11, 2016

(54) DRILL BIT AND CYLINDER BODY DEVICE, ASSEMBLIES, SYSTEMS AND METHODS

(71) Applicant: William Harrison Zurn, Sunnyvale, CA (US)

(72) Inventor: William Harrison Zurn, Sunnyvale, CA (US)

(73) Assignee: William Harrison Zurn, Sunnyvale, CA (US)

( * ) Notice: Subject to any disclaimer, the term of this patent is extended or adjusted under 35 U.S.C. 154(b) by 0 days.

(21) Appl. No.: 14/806,340

(22) Filed: Jul. 22, 2015

(51) Int. Cl.

| | |
|---|---|
| ***E21B 10/00*** | (2006.01) |
| ***E21B 12/02*** | (2006.01) |
| ***E21B 3/00*** | (2006.01) |
| ***E21B 4/00*** | (2006.01) |
| ***E21B 47/12*** | (2012.01) |

(52) U.S. Cl.
CPC ..... *E21B 12/02* (2013.01); *E21B 3/00* (2013.01); *E21B 4/00* (2013.01); *E21B 47/122* (2013.01)

(58) Field of Classification Search
USPC ..... 175/39, 57, 50, 92
See application file for complete search history.

(56) References Cited

U.S. PATENT DOCUMENTS

| | | | |
|---|---|---|---|
| 4,297,880 | A | 11/1981 | Berger |
| 4,548,443 | A | 10/1985 | Turner |
| 4,624,327 | A | 11/1986 | Reichman |
| 4,805,449 | A | 2/1989 | Das |
| 4,818,026 | A | 4/1989 | Yamazaki et al. |
| 4,953,914 | A | 9/1990 | LeBegue |
| 5,005,911 | A | 4/1991 | Fikse |
| 5,035,071 | A | 7/1991 | Stotzer et al. |
| 5,125,719 | A | 6/1992 | Snyder |
| 5,203,614 | A | 4/1993 | Robbins et al. |
| 5,205,613 | A | 4/1993 | Brown, Jr. |
| 5,234,257 | A | 8/1993 | Sugden et al. |
| 5,308,151 | A | 5/1994 | Sugden et al. |
| 5,324,139 | A | 6/1994 | Wagner et al. |
| 5,443,305 | A | 8/1995 | Heierli et al. |
| 5,527,135 | A | 6/1996 | Hayashi et al. |
| 5,765,925 | A | 6/1998 | Kondo et al. |
| 5,862,871 | A | 1/1999 | Curlett |
| 6,076,047 | A | 6/2000 | Ito et al. |
| 6,131,676 | A | 10/2000 | Friant et al. |
| 6,142,577 | A | 11/2000 | Tayama et al. |
| 6,194,354 | B1 | 2/2001 | Hatchman |
| 6,206,109 | B1 | 3/2001 | Monier et al. |
| 6,287,052 | B1 | 9/2001 | Basset et al. |
| 6,289,286 | B1 | 9/2001 | Andersson et al. |
| 6,314,374 | B1 | 11/2001 | Ito et al. |
| 6,329,824 | B1 | 12/2001 | Tsuzuki et al. |
| 6,348,795 | B2 | 2/2002 | Pringle, Jr. et al. |
| 6,367,569 | B1 | 4/2002 | Walk |

(Continued)

OTHER PUBLICATIONS

Buckman et al., "A new approach to drilling", Oilfield Technology, Aug. 2013, pp. 1-4.

(Continued)

*Primary Examiner* — Taras P Bemko
(74) *Attorney, Agent, or Firm* — Law Office of Alan W. Cannon; Alan W. Cannon

(57) ABSTRACT

A drilling system includes a cylinder body and drill bit assembly. The drill bit includes a plurality of drill bit blades, each having at least one drill bit element. A cylinder body is connected to the drill bit. A plurality of transmitters are mounted on each drill bit element and transmit data characterizing a degree of wear of the drill bit to a data transmitter and receiver of the cylinder body that is in communication with the plurality of transmitters.

19 Claims, 13 Drawing Sheets

(56) References Cited

U.S. PATENT DOCUMENTS

| | | | |
|---|---|---|---|
| 6,415,232 | B1 | 7/2002 | Hayashi |
| 6,431,653 | B1 | 8/2002 | Kleuters |
| 6,510,907 | B1 | 1/2003 | Blange |
| 6,565,285 | B1 | 5/2003 | Landrichter |
| 6,630,309 | B2 | 10/2003 | Willner et al. |
| 6,688,408 | B2 | 2/2004 | Barbera et al. |
| 6,708,786 | B2 | 3/2004 | Cariveau et al. |
| 6,748,333 | B1 | 6/2004 | Ito et al. |
| 6,831,042 | B2 | 12/2004 | Ristol et al. |
| 6,842,088 | B2 | 1/2005 | Yamada et al. |
| 6,848,295 | B2 | 2/2005 | Auner et al. |
| 6,857,488 | B2 | 2/2005 | Pastor |
| 6,906,919 | B2 | 6/2005 | Pokharna et al. |
| 7,048,050 | B2 | 5/2006 | Vail, III et al. |
| 7,195,079 | B2 | 3/2007 | Self et al. |
| 7,195,083 | B2 | 3/2007 | Eppink et al. |
| 7,510,025 | B2 | 3/2009 | Davies |
| 7,514,628 | B2 | 4/2009 | Kadrnoska et al. |
| 7,718,581 | B2 | 5/2010 | Egli et al. |
| 7,731,453 | B2 | 6/2010 | Stein |
| 7,903,926 | B2 | 3/2011 | Cody et al. |
| 7,997,659 | B2 | 8/2011 | Oertley et al. |
| 8,020,436 | B2 | 9/2011 | Bostick, III |
| 2002/0020559 | A1* | 2/2002 | Barbera ..... E21B 7/04 175/19 |
| 2005/0230149 | A1* | 10/2005 | Boucher ..... E21B 47/12 175/48 |
| 2011/0031017 | A1* | 2/2011 | Iwata ..... E21B 12/02 175/40 |
| 2011/0209921 | A1* | 9/2011 | Barbera ..... E21B 7/201 175/336 |
| 2012/0012393 | A1* | 1/2012 | Kumar ..... E21B 25/00 175/58 |
| 2013/0068525 | A1* | 3/2013 | Digiovanni ..... E21B 47/01 175/40 |
| 2014/0111210 | A1* | 4/2014 | Fang ..... E21B 47/0905 324/346 |

OTHER PUBLICATIONS

Veenhuizen et al., "Ultra-High Pressure Jet Assist of Mechanical Drilling", SPE/ADC Drilling Conference, Amsterdam, Mar. 4-6, 1997, pp. 79-90.

* cited by examiner

DRILL BIT AND CYLINDER BODY DEVICE, ASSEMBLIES, SYSTEMS AND METHODS

FIELD OF THE INVENTION

The present invention relates to drill bit and cylinder devices used for drilling into rock, soil, and various types of muck. The present invention relates to coupling and decoupling drill bits to cylinder housings for use with horizontal or vertical directional drilling operations.

BACKGROUND OF THE INVENTION

Drilling an oil field well for hydrocarbons requires significant expenditures of manpower and equipment. Constant advances are being sought to reduce any downtime of equipment and expedite any repairs that become necessary. Rotating equipment is particularly prone to maintenance as the drilling environment produces abrasive cuttings detrimental to the longevity of rotating seals, bearings, packing glands and drill bits.

A well bore is any hole drilled for the purpose of exploration or extraction of natural resources such as water, gas or oil where a well may be produced and a resource extracted for a protracted period.

The method of drilling a well bore or cutting a configuration to create a tunnel and other subterranean earthen excavations is an exceedingly mutually dependent course of action that, if possible, incorporates and takes into account many variables: to guarantee that a usable well bore or tunnel is constructed. As is commonly known in the art, numerous essentials have an interactive and collective consequence of increasing drilling expenses. These variables may include formation hardness, abrasiveness, pore pressures and formation elastic properties.

In drilling well bores, formation rigidity and an equivalent degree of drilling complexity may increase exponentially as a function of escalating depth. A high percentage of the costs to drill a well bore are derived from interdependent operations that are time sensitive, i.e., the longer it takes to access the formation being drilled, the higher the expense. An important aspect affecting the cost of drilling a well bore is the rate at which the formation can be accessed by the drill bit, which typically decreases with harder and tougher formation materials and formation depth. Another factor is: how often the drill blades or drill bits must be replaced. As a result, drilling costs typically tend to increase significantly, with distance downward or horizontal into a formation.

There have been many considerably diverse efforts to meaningfully increase the effective rate of penetration ("ROP") during the drilling process and to thereby reduce the cost of drilling or cutting formations by improving drill bit effectiveness. Maurer et al. in "A new approach to drilling", Oilfield Technology, August 2013 outline several innovative methods with respect to concentrating on the subject of ever-increasing the degree of penetration, exemplifying the remarkable interest, breadth of partaking and noteworthy funds exhausted endeavoring to fulfill the necessity for significantly increasing the ROP.

Three noteworthy efforts of a constant characteristic to importantly increase ROPs warrant discussion relating to this invention. The first two of these efforts involve high-pressure circulation of a drilling fluid as a foundation for potentially increasing the rate of penetration. It is common knowledge that hydraulic power available at the rig site vastly outweighs the power available to be functioning mechanically at the drill bit. Modern drilling rigs skilled in drilling a deep well normally have in surplus of 3000 hydraulic horsepower available and can have in surplus of 6000 hydraulic horsepower accessible while less than one-tenth of that hydraulic horsepower may be accessible at the drill bit.

Innovative procedures must improve this ratio of power loss at the drill bit and provide additional hydraulic or other types of energy to the drill bit to be more efficient.

Comprehensive work conducted in attempting to use drilling fluid entrained abrasives was conducted by Gulf Research and Development Company. This work is described in multiple published articles and is the topic of many issued patents. This body of work instructs the use of abrasive laden jet streams to cut concentric grooves in the bottom of the hole leaving concentric ridges that are then broken by the mechanical contact of the drill bit. There was sufficient illustration that the use of entrained abrasives in conjunction with high drilling fluid pressures produced accelerated erosion of surface equipment and a lack of ability to manage drilling mud density, among other issues.

Directional drilling, both vertical and horizontal, is a useful process for numerous types of drilling such as: utility installation, fiber optic cabling, oil drilling, natural gas, water and sewer lines, etc. One widespread category of directional drilling is horizontal directional drilling (HDD), where a drill tube is essentially extended horizontally to form a passageway underground, thereby eliminating the need for the formation of a trench.

Drill bits in directional drilling typically have a characteristic which enables the drill bit to maneuver in one direction when forced ahead by a drilling device. Force is applied through a drill tube from behind to the drill bit. During a typical well bore operation, the drill bit assembly is usually rotated at a regular rate so that on average, only perpendicular ahead drilling is possible. With the need to change direction, the rotation of the drill bit is briefly stopped, and the drill bit is able to maneuver in the preferred course. When the steering exercise is finished, the drill bit is again rotated at a regular rate for straight ahead drilling.

In many HDD operations, an electronic transmitter called a sonde is coupled to the end of the drill tube. Signals transmitted from the sonde are sensed by a receiver within equipment above ground. A variety of characteristics of the detected signal are then used to indicate such elements as: GPS location of the drill bit, water features, soil aspects etc. ahead of the drill bit. This data can then be utilized to maneuver the drill bit in a desired direction.

There are a multiplicity of approaches for calculating downhole drilling fluid pressure; some of the plans necessitate a temporary termination of drilling operations. These issues incur cost and time delays objectionable to drilling operations in the oil exploration market.

Some systems permit downhole pressure measurement as drilling takes place, usually using electronic pressure measurement apparatus firmly set to the lower portion of the drill bit. These devices are written off in the event that this section of the drill string becomes trapped downhole, and as a result discarded if efforts to liberate the device are unproductive. The drill string above the trapped section is disconnected in some fashion and brought to the surface, leaving behind the drill motor, drill bit, pressure measurement tools and the lower section of the drill string. Such systems are described in U.S. Pat. Nos. 4,297,880 and 4,805,449, both of which are hereby incorporated herein, in their entireties, by reference thereto.

Descriptive tunnel boring machines are disclosed in U.S. Pat. No. 4,548,443, which is hereby incorporated herein, in its entirety, by reference thereto. Additional descriptive prior art tunnel boring machines are disclosed in U.S. Pat. No. 5,205,613 and U.S. Pat. No. 6,431,653, both of which are hereby incorporated by reference in their entirety.

Another noteworthy effort at increasing rates of penetration by benefit of hydraulic horsepower accessible at the bit was described by Curlett, U.S. Pat. No. 5,862,871. This method utilized a specialized nozzle to excite typically pressured drilling mud at the drill bit. The objective of this nozzle system was to increase local pressure fluctuations and a high speed, dual jet form of hydraulic jet streams to more effectively scavenge and clean both the drill bit and the formation being drilled.

Another noteworthy attempt to directly harness and successfully utilize the hydraulic horsepower available at the bit incorporated the use of ultra-high pressure jet assisted drilling. FlowDril Corporation was formed to improve an ultra-high-pressure liquid jet drilling system in an effort to considerably intensify the degree of penetration. The work was based upon by Reichman, U.S. Pat. No. 4,624,327. The obstacles of pumping and transporting ultra-high-pressure fluid from surface pumping equipment to the drill bit proved both operationally and economically unfeasible. FlowDril Corporation is continuing development of an "Ultra-High Pressure Down Hole Intensifier" as a substitute technology in an effort to commercialize its product. FlowDril demonstrated that producing a cut of a certain width near the hole gage will create increased efficiencies for the mechanical accomplishment of the drill bit. This is cited in the conclusions stated in the article titled "Ultra-High Pressure Jet Assist of Mechanical Drilling" authored by S. D. Veehuizen, FlowDril Corp; J. J. Kolle, Hydropulse L. L. C.; and C. C. Rice and T. A. O'Hanlon, FlowDril Corp. published by SPE/IADC Drilling Conference publications, paper 37579.

U.S. Pat. No. 5,308,151 discloses a distinct type of mining machine with drill bits that are present with drill bit shaft strain gauges to make available a calculation of the direct load on one or more roller drill bit assemblies. One or more of the drill bit shafts are provided with a strain gauge to provide a measure of the direct load on the roller drill bit assembly.

U.S. Pat. No. 4,818,026, Yamazaki et al, discloses a mining machine that transports cut bedrock through the bit to the tunneling machine core. In a central region of the bit compartment is provided a debris receiving chamber into which are channeled the front-end portion of a screw conveyor and the front-end portion of a water supply pipe. A rear-end portion of the water supply pipe is connected to a water-supply source disposed in a back area of the tunneling apparatus. The water comes from a water supply source to the debris receiving chamber through its upper opening so that the bit compartment is filled with water which buoys up the rock debris to enable the debris to easily enter the debris receiving chamber through its upper opening under the influence of the rotational movement of the bit compartment. The rock debris received in the debris receiving chamber is transported rearwardly together with water by means of the screw element of the screw conveyor, reaching an outlet opening of an outer sleeve of the screw conveyor, and then dropping therefrom to a rock crusher.

A noteworthy undertaking at increasing rates of penetration was an attempt to directly harness and effectively utilize hydraulic horsepower at the drill bit by incorporating entrained abrasives in conjunction with high pressure drilling fluid ("mud"). This method was summarized in U.S. Pat. No. 6,510,907 by Blange.

Kadrnoska describes, in U.S. Pat. No. 7,514,628, a laid cable configuration containing cables, preferably electric cables, data and information transport cables and/or control cables, in particular fiber optic cables, and fluid transport tubes, to be disposed in galleries, tunnels, shafts, pipes, channels or the like, in particular water and/or waste-water guiding systems. The configuration contains at least one cable to be laid, which can be unwound from a drum from the region of an opening providing access to an installation shaft or access shaft toward the respective pipe or channel, or drawn or fixed in a stationary manner in the pipe, channel or the like. The configuration includes a flexible and/or articulated carrier band having lateral edges that are laid against an inner wall surface of the pipe or the channel.

Subterranean boring machines are used to install a pipe comprised of multiple casing sections or a similar product in the ground without excavating a trench for the pipe. Some boring machines are used to bore a generally horizontal hole and to install a plurality of pipe sections therein between a generally vertical launch shaft or pit and a similarly oriented target shaft or pit. The launch shaft or pit is excavated to a depth permitting the boring machine to be placed in alignment and on grade with the desired underground installation. Boring machines that are commonly placed in such launch pits generally include a track that is located at the bottom of the launch pit and oriented along the desired boring direction, and a carriage that rolls or otherwise travels along the track. The carriage includes a pusher mechanism that is adapted to move the carriage along the track between a start point and a terminal point, and a rotational mechanism that is adapted to rotate a tool carried by the boring machine.

Cody describes in U.S. Pat. No. 7,903,926 an invention using a cable assembly comprising a fiber optic cable and one or more attachment points to allow one or more tethers to optically connect to optical fibers within the cable. The cable assembly may be used as a drop cable for extending optical connections to a plurality of points. An attachment structure is provided for maintaining the tether to the cable to prevent damage to the tether. The attachment structure provides a loose attachment to allow the tether to move relative to the distribution cable, so the tether can move in a generally translational movement, is able to slightly twist, and to have limited lateral movement during coiling, installation, and removal of the cable assembly.

Weaver describes, in U.S. Pat. No. 8,413,964, an optical fiber installation device. A drive wheel may be rotatably positioned in the housing and configured to engage a fiber optic drop provided in the drop receiving channel. The housing may include an air pathway for applying a first flow of pressurized air from an air source to the drive wheel. The first flow of pressurized air may cause the drive wheel to rotate and propel the fiber optic drop through the drop receiving channel.

Dofher describes, in U.S. Pat. No. 8,417,083, a fiber optic network system for a multi-staged installation to a plurality of present and future user locations including an aggregation point, a trunk line with a plurality of optic fiber cables leading from the aggregation point and at least one branch junction location to serve a future cable user. The trunk line includes at least one dark cable having a free end for removal from the branch junction location. The trunk line includes a trunk conduit having opposing side walls defining an interior space between the side walls for housing the cables. The conduit is configured to permit withdrawal of the length of dark cable from the conduit at a stage subsequent to installation of the trunk line to form a branch leading to the future user location. The dark cable stored within the interior of the conduit has sufficient length to reach the location of the future user.

Bostick describes, in U.S. Pat. No. 8,020,436, an invention including a fiber optic seismic sensing system, for permanent down hole installation. The invention includes a multi-station, multi-component system for conducting seismic reservoir imaging and monitoring in a well. Permanent seismic surveys may be conducted with embodiments of the invention, including time-lapse (4D) vertical seismic profiling (VSP) and extended micro-seismic monitoring. The invention provides the ability to map fluid contacts in the reservoir using 4D VSP and to correlate micro-seismic events to gas injection and production activity.

SUMMARY OF THE INVENTION

According to one aspect of the present invention, a cylinder body and drill bit assembly is provided that includes: a drill bit comprising a plurality of drill bit elements, each the drill bit element comprising at least one drill bit blade; a cylinder body connected to said drill bit; and a plurality of transmitters mounted on each the drill bit blade; the cylinder body comprising a data transmitter and receiver in communication with the plurality of transmitters; wherein the plurality of transmitters provide data characterizing a degree of wear of the drill bit.

In at least one embodiment, the data transmitter and receiver indicates transmissions from each of the plurality of transmitters when there is no wear on the drill bit, and a percentage of the total number of the plurality of transmitters from which transmissions are no longer received after wear of the drill bit indicates a percentage of wear of the drill bit.

In at least one embodiment, the plurality of transmitters comprises a plurality of MEMS transmitters.

In at least one embodiment, the MEMS transmitters comprise MEMS cone transmitters.

In at least one embodiment, the data transmitter and receiver transmits data received from the plurality of transmitters to an external computer.

In at least one embodiment, the assembly further includes: at least one instrument contained in the cylinder body and in electrical communication with an external computer, the at least one instrument comprising at least one sensor configured to monitor an environment in which drilling activities are occurring.

In at least one embodiment, the at least one sensor comprises at least one of a sonde or an accelerometer.

In at least one embodiment, the at least one sensor comprises a gradiometer.

In at least one embodiment, the at least one sensor comprises a pressure transducer.

In at least one embodiment, the at least one sensor comprises a chromatograph.

In at least one embodiment, the cylinder body comprises an attach/detach assembly for attaching to and detaching from a pipe.

In at least one embodiment, the attach/detach assembly comprises magnetic field generating elements.

In at least one embodiment, the assembly further includes magnetic field generating elements configured to rotate the drill bit relative to the cylinder body.

In at least one embodiment, the assembly further includes a cylinder body and drill bit assembly power bus bar and a bus bar connector configured to electrically connect the cylinder body and drill bit assembly power bus bar with a pipe power bus bar in a pipe.

In at least one embodiment, the drill bit comprises a central opening when the drill bit is rotating, and wherein the central opening is closed off when the drill bit is not rotating such that the drill bit can function as a pig.

In another aspect of the present invention, a drilling system includes: a drill bit comprising a plurality of drill bit elements, each the drill bit element comprising at least one drill bit blade; a cylinder body connected to the drill bit; drill bit magnetic field generating elements configured to rotate the drill bit relative to the cylinder body; the cylinder body further comprising cylinder magnetic field generating elements; and a last pipe comprising pipe magnetic field generating elements; wherein the cylinder magnetic field generating elements and the pipe magnetic field generating elements are configured to translate the drill bit and cylinder body relative to the last pipe, and to lock the cylinder in an operational position relative to the last pipe.

In at least one embodiment, the system further includes at least one additional pipe comprising pipe magnetic field generating elements configured to lock to one of the last pipe or another of the at least one additional pipe.

In at least one embodiment, the drill bit and cylinder body are translatable through the last pipe and the at least one additional pipe, being driven by the magnetic field generating elements.

In at least one embodiment, the drill bit blades comprise wear sensors.

In at least one embodiment, the wear sensors comprise MEMS cones.

In at least one embodiment, the MEMS cones comprise MEMS cones transmitters.

According to another aspect of the present invention, a method of operating a drilling system includes: providing a series of connected pipes through a pathway; and translating a cylinder body and drill bit assembly through at least a portion of the series of connected pipes; wherein the transporting is driven by magnetic field generating elements provided in the pipes and on the cylinder body and drill bit assembly.

In at least one embodiment, the method further includes locking the cylinder body to a last of the series of connected pipes, by the magnetic field generating elements.

In at least one embodiment, the method further includes rotating the drill bit assembly relative to the cylinder by the magnetic field generating elements.

In at least one embodiment, the method further includes ceasing rotation of the drill bit assembly, wherein a central opening in the drill bit assembly closes upon cessation of the rotation; and translating the cylinder and drill bit assembly through at least a portion of the series of connected pipes, wherein the closed drill bit assembly and cylinder functions as a pig during the translating.

In at least one embodiment, the method further includes translating a cable connected to the cylinder and drill bit assembly by the translating the cylinder and drill bit assembly.

In at least one embodiment, the method further includes wirelessly receiving transmissions of data characteristic of wear of drill blades of the drill bit assembly, from at least one wireless transmitter in the drill bit assembly by a wireless receiver in a last of the series of connected pipes; and transmitting the data through a communication and power bus bar that extends through the series of connected pipes, to a controller located proximally of the series of connected pipes.

In at least one embodiment, the data is received from wear sensors on the drill bit blades, and, as a portion of the wear sensors are worn to the extent that they no longer transmit, the controller calculates a wear percentage of the drill blades based on a percentage of the wear sensors that data is currently received from.

In at least one embodiment, the wear sensors comprise MEMS cones.

In at least one embodiment, the method further includes: sensing data representative of at least one of pressure, temperature, location, flow and chemical composition of material in contact with the drill bit assembly by at least one sensor in the cylinder and drill bit assembly; and transmitting the data through a communication and power bus bar that extends through the series of connected pipes, to a controller located proximally of the series of connected pipes.

These and other features of the invention will become apparent to those persons skilled in the art upon reading the details of the assemblies, systems and methods as more fully described below.

DETAILED DESCRIPTION OF THE INVENTION

Figure 1A:
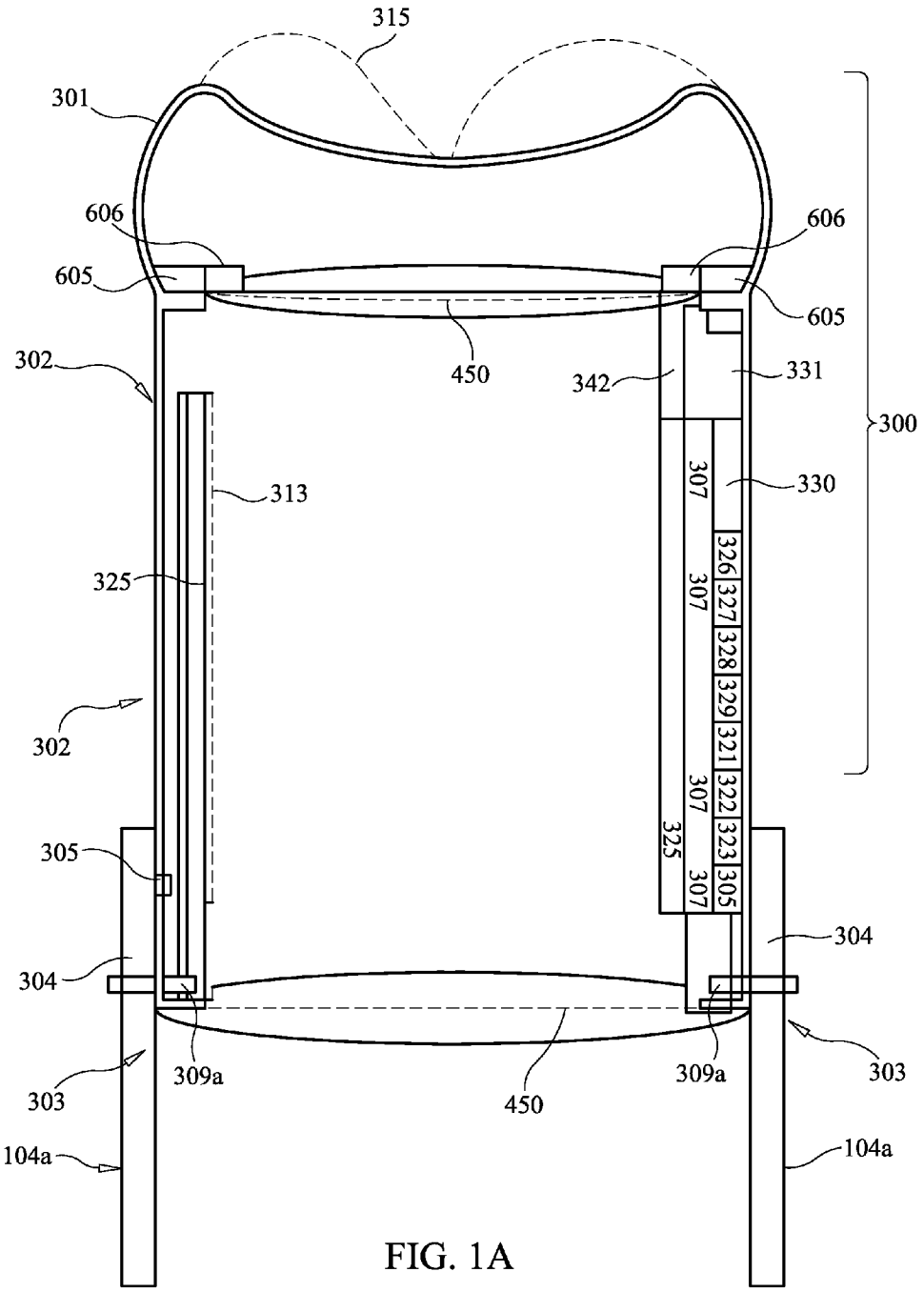
FIG. 1A is a schematic representation of a cylinder body/drill bit assembly (CBDB) according to an embodiment of the present invention.

Before the present systems and methods are described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned herein are incorporated herein by reference to disclose and describe the methods and/or materials in connection with which the publications are cited.

It must be noted that as used herein and in the appended claims, the singular forms "a", "an", and "the" include plural referents unless the context clearly dictates otherwise. Thus, for example, reference to "a sensor" includes a plurality of such sensors and reference to "the transmitter" includes reference to one or more transmitters and equivalents thereof known to those skilled in the art, and so forth.

The publications discussed herein are provided solely for their disclosure prior to the filing date of the present application. The dates of publication provided may be different from the actual publication dates which may need to be independently confirmed.

Definitions

A "well bore", as used herein, refers to any hole drilled for the purpose of exploration or extraction of natural resources such as water, gas or oil where a well may be produced and a resource extracted for a protracted period. Additionally, the term "well-bore" may refer to a hole or tunnel drilled for placing (laying) fiber optic cables, utility lines, etc.

As used herein, the term "muck" refers to: soil, crushed rock, other debris.

As used herein, the term "pig" refers to: a device used to clear an oil pipeline.

The term "desecrated" is used herein to mean: a drill blade worn down to the point that is not operational to use. The operational range most often would be from 100% to 60% drill blade wear as a preferred range. The operational range could be changed to 100% to 80%, in cases where operators would prefer to change to drill blades more often. In the case of the range of 100% to 80%, when the 80% cone transmitter stops transmitting, this indicates that it is time to change the blade. The present invention is not limited to the ranges provided, as the threshold indicating desecration may be set any an percentage above 0%, such as 50%, 40%, 30%, etc., or any other value greater than 0%.

"Micro-Electro-Mechanical Systems" (MEMS), involves the integration of mechanical elements, sensors, transducers, actuators, and electronics on a common silicon substrate through microfabrication technology. While the electronics are fabricated using integrated circuit (IC) process sequences (e.g., CMOS (Complementary Metal Oxide Semiconductor), Bipolar, or BICMOS (Bipolar Complementary Metal Oxide Semiconductor) processes), the micromechanical components are fabricated using compatible "micromachining" processes that selectively etch away parts of the silicon wafer or add new structural layers to form the mechanical and electromechanical devices. Microelectromechanical systems (MEMS) (also written as micro-electromechanical, MicroElectroMechanical or microelectronic and microelectromechanical systems) is the technology of very small mechanical devices driven by electricity; it merges at the nano-scale into nanoelectromechanical systems (NEMS) and nanotechnology.

MEMS are made up of components between around 1 to 100 micrometers in size (i.e. 0.001 to 0.1 mm) and MEMS devices generally range in size from about 20 micrometers (20 millionths of a meter) to a millimeter. They usually include a central unit that processes data, the microprocessor, and several components that interact with the outside such as microsensors. The following materials have been used to construct MEMS devices, single crystal silicon (Si), polycrystalline silicon (polysilicon), silicon oxide (SiO2), silicon nitride (Si3N4), single crystal cubic silicon carbide (3C-SiC or b-SiC), titanium (Ti).

An "integrated circuit" (IC) is an electronic circuit manufactured by the patterned diffusion of trace elements into the surface of a thin substrate of semiconductor material. Integrated circuits (IC) are constructed of semiconducting materials, which are midway between good conductors, like copper, and insulators such as plastic. Silicon is the current favorite. Ultrapure silicon is mixed with small, precise amounts of other elements to create electronic materials with different characteristics. Additional materials are deposited and patterned to form interconnections between semiconductor devices. Integrated circuits may be small squares of silicon, imprinted with microscopic patterns. The patterns may contain hundreds of millions of transistors, resistors and other electronic parts.

Detailed Description

The present invention generally provides more efficient and cost effective systems and methods for boring tunnels, well bores, and other types of penetrating passageways. The invention provides for reduced downtime maintenance in regard to drilling operations, and methods for replacing and/or repairing machinery in well boring, tunnel boring and drilling applications. The present invention also has applications for microtunneling.

Provided herein are apparatus and methods relating to a tunnel boring machine (TBM) for a trenchless underground laying of oil exploratory drilling, oil pipelines, fiber optic channels, natural gas pipes, water pipes, waste water pipes, conduits, tubes, underground cables, etc. A procedure comprising: a multitude of pipes launched from a launching site, driving through a targeted pathway position, a tunnel boring machine and supporting pipes following the apparatus. The apparatus will produce a well bore using improved innovative drill bit and a cylinder body, thus providing a diameter of the bore that is slightly larger than an outer diameter of the tubes/pipes.

A method of drilling described above can also be used for drilling natural gas pipelines or drilling for installing a fiber optic cable, water or sewer lines. In the case of a fiber optic cable line, water lines or sewer lines: the launch assembly apparatus would be mobile, with the ability to be moved out of the launch pit, allowing the permanent fiber optic cable line, water line or sewer line connection to be completed. In another example application, electrical, power cables or other types of utility cables can be run using apparatus and methods of the present invention. Additional examples include, but are not limited to: boring and drilling under obstructions such as; mountains, lakes, rivers and other natural obstructions.

Also disclosed as an aspect of the present invention is a process of monitoring the degradation factor of a drill bit within a cylinder body and drill bit assembly (CBDB) during operation of a drilling machine. According to at least one embodiment of the present invention, the cylinder body and drill bit (CBDB) comprises a plurality of micro-electromechanical systems (MEMS) assemblies each having a rotatable portion mounted on a cylinder body. A plurality of instrument packages may be provided, each instrument package being associated with one of a plurality of drill bit assemblies, each instrument package comprising a distal end that is in contact with the associated drill bit assembly. Each instrument package contains a plurality of sensors for monitoring various drilling activities. A plurality of transmitters and receivers may be provided which are adapted to transmit and receive data detected by the plurality of sensors within the drill bits to a remote receiver, and a power source is connected to provide power to the sensors.

An amalgamation of Micro-Electro-Mechanical Systems (MEMS) and semiconductor (IC) technology may be provided to a drill system to include electric and mechanical elements, sensors, actuators, and embedded electronics onto modules and devices through nano manufacturing technology and semiconductor technology to more efficiently: drill well bores and tunnels.

A guidance assembly includes a global positioning satellite (GPS) gradiometer that is mounted within a cylinder body assembly and oriented so as to direct a preferred boring course within the targeted location. The GPS gradiometer can be configured within the cylinder body to indicate the roll orientation of the drill bit blades, and a roll correction assembly can be provided to roll the drill bit blades, if desired, to adjust roll orientation.

The GPS gradiometer determines the location and pathway target components and is mountable within the (CBDB) cylinder body/drill bit with GPS capabilities. The GPS gradiometer element is parallel to the adjoining drill bit, ahead of the cylinder body. The location target pathway has a target point which is intersected by the GPS gradiometer when the CBDB is properly oriented with respect to the desired boring direction towards the pathway.

The present invention may include a plurality of instrument devices embedded within a drill bit and cylinder body assembly. The instrument devices comprise a plurality of elements, which may include at least one, up to all of: an accelerometer, a gradiometer, a sonde and a temperature sensor; for monitoring associated drilling activities. The cylinder body may also include unused space for future improvements such as: advanced field programmable gate assemblies (FPGA)'s, advanced communication technology, WiMAX (Worldwide Interoperability for Microwave Access) devices, System-on-a-Chip, etc.

The MEMS or integrated circuit (IC) sensors, monitoring drill bit ware, may be embedded within the rotating drill bits. The instrument devices include a MEMS transmitter/receiver, and are in communication with a receiver within the cylinder body. A MEMS power supply, a battery, may be embedded within the drill bit assembly providing power for each device. Magnetic forces are applied by the cylinder body to rotate the drill bit assembly.

The cylinder body drill bit assembly (CBDB) may include a chromatograph technology capable of simultaneously collecting data by a scan measurement for analyzing the material passing through the CBDB. The sensors in the cylinder body determine the type of material, passing through the cylinder body, there for, in front of the drill bit. This analysis, provides feedback to a control master system, which can then adjust the speed (slow down or speed up) of the drill bit assembly depending upon the type of material ahead of the drill bit assembly.

Further optional equipment may include, but is not limited to: flow sensors, electromagnet movement device, such as MFGE (magnetic field generating elements). This optional equipment can be contained within the pipes and the (CBDB), and can function to move the CBDB, back and forth, all the way through the pipes to the initial launch pit if necessary. The flow sensors measure the resistance of the movement of the crushed rock, soil, muck and other material within the CBDB and pipes. Pressure transducers can be provided to aid the movement flow of the muck down the pipes to the initial launch pit.

In case of a possible blockage or a buildup in resistance in the muck flow, the CBDB assembly can be transformed into a clearing pig to aid in clearing a present or potential blockage. The amount of resistance or blockage of material within the pipes determines the need for the CBDB to be transformed to the pig, so the path can be cleared, and the CBDB can be withdrawn all the way to the initial launch pit if necessary. Ongoing feedback provides information with respect to the amount of resistance applied to the flow sensors. The combination of the flow sensors measurements and pressure transducers propelling force provide useful, real time data, to aid the drilling process. Power and communication bus bars (links) connect each pipe, allowing communication to the CBDB from the initial launch pit control center. After the drilling operation is completed, the flow sensors and pressure transducers aid the measurement of the optimum flow of oil, or other substance moved along the pipeline if necessary.

The CBDB, when transformed, resembles an oil pipeline pig, which is a device used for maintenance and clearing blockages on pipelines. The diameter of the CBDB is slightly less than the least inner diameter of the pipe, tube, conduit, etc. In case the pipe, conduit, tube must be cleared; the CBDB assembly will be withdrawn through the length of the conduit/pipe, if necessary, until the obstruction is cleared.

An aspect of the present invention is that the CBDB can be returned/retrieved to the initial launch pit or intermediate launch pit for maintenance and/or repair. Periodically, the drill bit blades must be replaced. The process of returning/retrieving the CBDB to the initial launch pit or intermediate launch pit, greatly improves the drilling operation.

The sensors provide feedback of the drilling activities, which minimize problems of equipment failure or delays in the drilling process. The data from the sensors can be used to control operation of the tunnel boring/drilling machine and/or to monitor the condition of the drill bit assembly.

Thus the present invention provides a more efficient, reduced downtime maintenance apparatus and method relative to currently existing apparatus and methods. According to the present invention, rotating portions of drill bit assemblies can be removed without having to remove any portion of the pipes, tubes, conduits at the front of the pathway.

FIG. 1A is a schematic representation of a cylinder body/drill bit assembly (CBDB) 300 according to an embodiment of the present invention. The assembly 300 is connected to the last pipe 104*a* (specified in more detail in FIG. 2A). The CBDB 300 of FIG. 1A includes a drill bit blade assembly 301 (sometimes referred to as the "cutter head", a cylinder body 302 and attach/detach assembly 303. The drill bit blade assembly 301 shown includes three sets of drill bit elements 315 each having three drill blades 217 (e.g., see FIG. 3B). Each drill bit element 315 may have three drill bit blades 117, as illustrated in FIG. 3B, but may have more or fewer than three drill bit blades 117. The (CBDB) 300 connects to the end of the last pipe 104*a* by use of the attach/detach assembly 303, which includes a pair of MFGE's 304 within the last pipe 104*a* and MFGE elements 305 within the CBDB 300. The MFGE's (magnetic field generating elements) 304, inside of the pipes, are also used to move the CBDB 300 back and forth inside of the pipe 104*a* (and all other pipes 104) by switching the magnetic fields of the MFGE's 304. The switching of the magnetic fields of the MFGE's 304 attracts and repels the magnetic elements within the CBDB 305. This action propels the CBDB back and forth within the pipes 104.

The attach/detach assembly 303 also locks the CBDB 300 into place, when the CBDB 300 is in the final placement (attached to the last pipe 104*a*); at which time the assembly 300 is in the normal drilling operation configuration.

The drill bit blade assembly 301 is rotated by use of the combination of the MFGE's 605/606, whereas energy from MFGE 605 within the CBDB 300 induces energy to the MFGE 606 within the drill bit (cutter head) assembly 301, stronger induced energy causes the drill bit to rotate faster. As the drill bit blade speed increases, the overall width of the drill bit blade assembly 301 increases slightly.

FIG. 1A also shows additional elements which may optionally be included within the cylinder body 302. The cylinder body 302 may include any or all of features such as: accelerometer 326, temperature sensor 327, sonde 328 and gradiometer 329. Optionally the CBDB 300 may not include all of the features 326, 327, 328 and 329, as any or all of these components can be added, or subtracted, depending upon the needs of the customer. Features 326-329 are electrically connected to the bus bar 307 for communications purposes. They transmit data from the elements 217 by wired connection back though the pipes 104, 104*a* to the master computer 95. Elements 326-329, when present, are located inside of the cylinder body 302.

The instrument devices (e.g., accelerometer 326, temperature sensor 327, sonde 328, gradiometer 329) can be used to guide the cylinder body 302, indicate the position of the cylinder body 302 in the ground, measure temperature within the cylinder body 302, and/or provide analysis of the material within the muck. The accelerometer 326 indicates how fast the drill bit 301 is rotating. One or more pressure transducers 325 may be provided within the cylinder body 302, to aid the movement (propulsion) of the muck down the CBDB 300. Pressure transducers 325 can also be provided within the pipes 104. The elements 326, 327, 328 and 329 can be hardwired to the wireless transmitter/receiver 330 provided in the cylinder body 302. The cylinder body 302 may also include unused space, such as at 321, 322, 323, for example, for mounting additional elements such as: advanced FPGA's (field programmable gate arrays) 321, advanced communication technology or WiMAX 322, System-on-a-Chip 323 to enhance computer functions within the cylinder 3202, provide more complex data, better communication, etc. FPGA 321 would allow changes of software by reprogramming without changing hardware. The elements 321, 322, 323 can also be hardwired to the wireless transmitter/receiver 330.

Further optionally, a chromatograph element 342 may be provided in cylinder body 302. Element 342 is capable of simultaneously collecting data, after multifaceted analysis of the material within the CBDB 300. A bus bar connection element 309*a* is contained within the attach/detach assembly 303 and connects the power bus bar 307 in the CBDB 300 to the last pipe 104*a*. Each pipe 104 has a bus bar connecter connection 309 with connection to each pipe 104, all of the pathway back to the initial launch pit. The bus bar elements 309*a*, one within the last pipe 104*a* and one within the attach/detach assembly 303 make the connection. The MEMS cones have their own bus bar (blade bus bar 219, See FIGS. 3C and 3D) Only the last pipe 104*a* has a bus bar connection 309*a*, all of the others, pipes 104 have bus bar connection 309. Bus bar connection 309*a* is different from bus bar connections 309 in that it connects communication from the last pipe 104*a* to the cylinder 300. Each pipe 104 has a bus bar element 307 and bus bar link 309, which allow communication from the cylinder 300 to the launch pit 100.

A bus bar connection element 106 (see FIG. 6A), within the initial launch pit 100, is switched on and off while adding additional pipes at the initial launch pit 100. The connection is switched on and left on when the CBDB 300 is in the final position at the end of the last pipe 104*a*, during travel along the pathway 109.

FIG. 1A further shows MFGE (magnetic field generating elements) 605 and 606 used to rotate the drill bit blade assembly 301, by similar technology that moves the CBDB 300 along the pipes to the end of the pipe 104*a*. The process of switching the phase (switching between north and south) and strength of the magnetic field of the MFGE elements 605 and 606 maintains the control and speed of drill bit assembly. This rotational motion transfers magnetic/electrical energy to mechanical energy. During switching, only 605 is switched (north and south polarity), which turns the 606 element, which turns the drill bit 301. Thus the energy transfer provided by switching the polarity of 605 relative to 606 functions as a motor. Element 605 is within the cylinder body 302 and element 606 is within the drill bit 301. The attractive forces between the elements 605, 606 also maintain the connection of the drill bit 301 to the cylinder body 302.

When the drill bits are rotating and operating, an opening 450, through the drill bit assembly 301 is present (indicated by the dotted line). The muck from drilling moves within the opening, through the CBDB 300 and the pipes 104 to the initial launch site, when the drill bits are rotating/operating. The opening 450 is closed when the drill bit is not rotating/operating. When the drill bit drill bit blade assembly 301 is not rotating, it now can act as a pig, as it can be returned to the initial launch site 100 to clear the pipes 104 and/or repair the CBDB 300.

The MFGE's 605 are connected to the bus bar 307 within the cylinder body 302, then connected to the connector 309*a*. within the last pipe 104*a*, which is connected to the bus bar 307 within the pipe 104. Each pipe 104 has a bus bar connector 309, allowing connection of all of the pipes 104 all the way back to the first pipe 104*b* bus bar connection element 106 at the launch pit 100 (see FIG. 6A). Electrical energy is transferred to the MFGE's 605, in turn, this magnetic/electrical energy turns the drill bit 301, the same as an electric motor. In this way, MFGE's 605 and 606 can be controlled by the master computer 95 via the launch pit 100, drive and control the speed of the drill bit drill bit blade assembly 301. As the speed increases, the drill bit widens, slightly increasing the diameter of the penetration into the pathway ahead of drill bit blade assembly 301. When the drill bit blade assembly 301 stops rotating, the opening 450 closes. The CBDB 301 may also contain a backup battery 331 (which may be rechargeable), connected to the communication and power bus bar 307, which in turn, is connected to all of the elements within the CBDB 301 that require power.

Figure 1B:
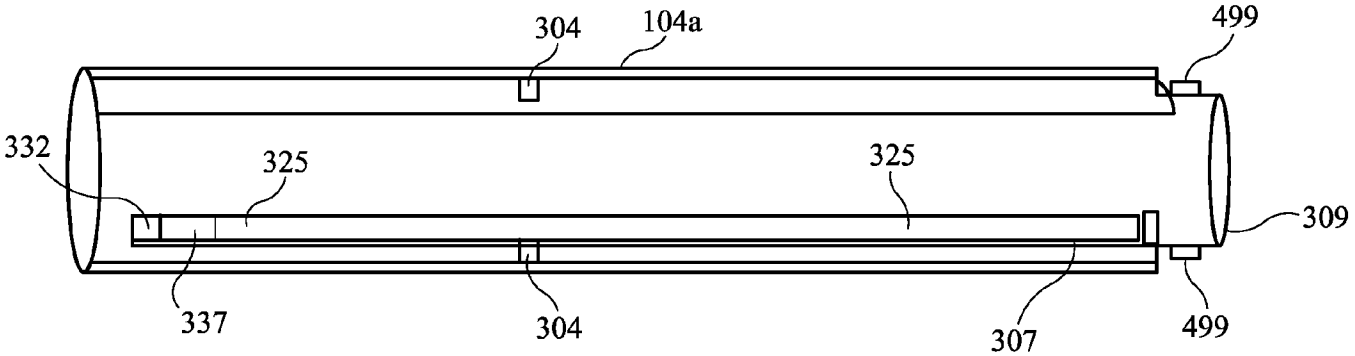
FIG. 1B is an isolated view of the last pipe that is partially shown in FIG. 1A.
Figure 1C:
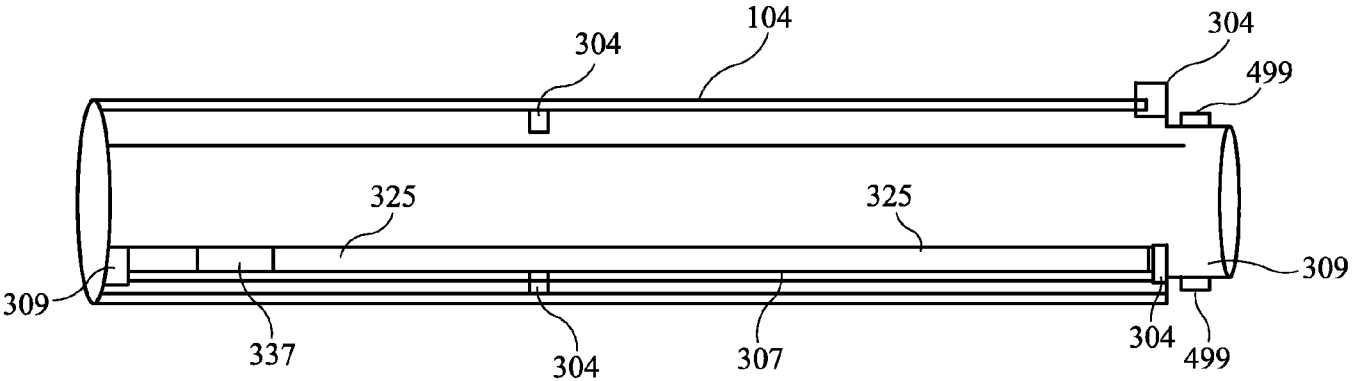
FIG. 1C is an isolated view of a pipe other than the last pipe, according to an embodiment of the present invention.

FIG. 1B is an isolated view of the last pipe 104*a* of FIG. 1A. Last pipe 104, in addition to the MfGE's 304, bus bar 307 and bus bar/power connector 309 and wireless receiver 332 described above, may include a flow sensor 337 and pressure transducers 325. Aside from the wireless receiver 332, the isolated view of FIG. 1C illustrates that the other pipes 104 attached in the pipeline may include the same components as the last pipe 104*a*.

Figure 1D:
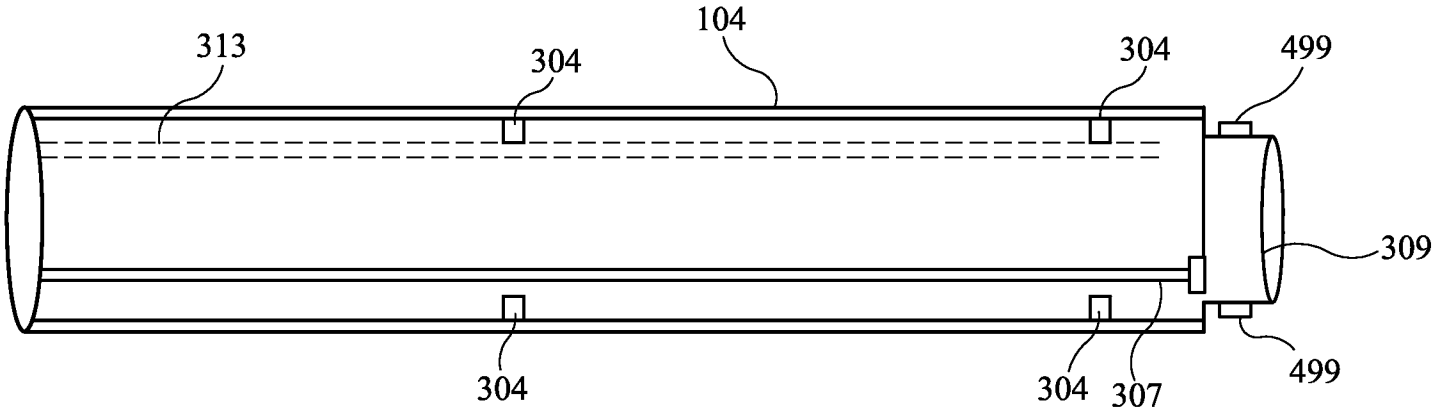
FIG. 1D is an isolated view of a pipe other than the last pipe that shown an optional lubrication channel that may be provided, according to an embodiment of the present invention.
Figure 2A:
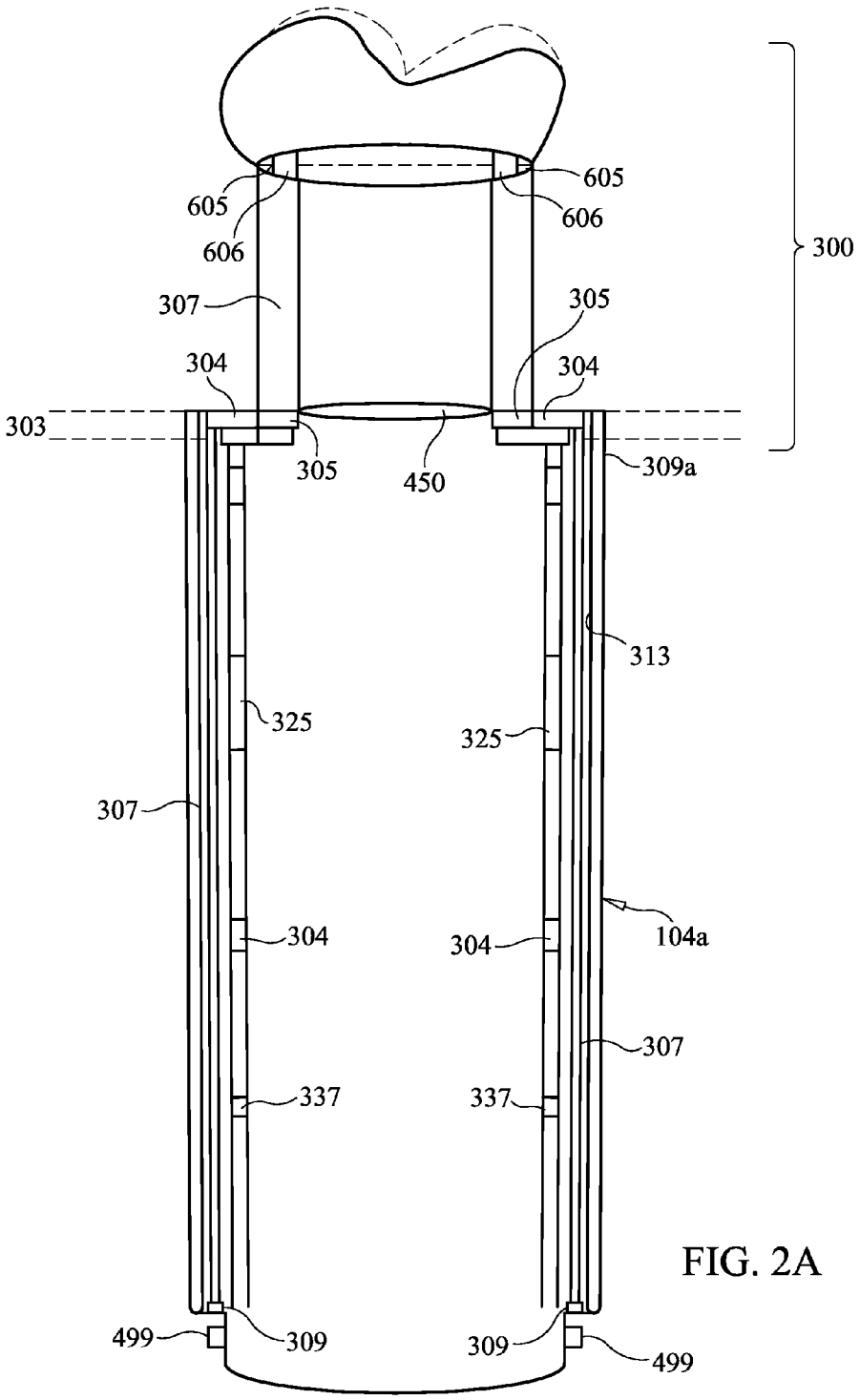
FIG. 2A is a schematic representation of the embodiment of FIG. 1A that shows more detail of the last pipe, according to an embodiment of the present invention.

FIG. 2A schematically illustrates the last pipe 104*a* in the pathway connected to the CBDB 300. The last pipe 104*a* includes pressure transducers 325 used in aiding the transfer (propelling by vacuum) of muck or other material to the initial launch pit 100 or an intermediate launch pit. The last pipe 104*a* also contains MFGE's 304/305 used to transport the CBDB 300 back and forth to and from the initial launch pit 100. The MFGE's 304/305 have two purposes, transporting the CBDB 300 back and forth to and from the initial launch pit 100, and locking the CBDB 300 into the final position at the last pipe 104*a*. The last pipe 104*a* contains a communication and power bus bar 307, which supplies the necessary power to the pipes and a bus bar connector 309*a*. The last pipe 104*a* contains a wireless receiver 332 which is not contained in the other pipes 104. Wireless receiver 332 receives information/data from the MEMS transmitter/receiver 218 (see FIG. 3B) in the drill bit assembly 301 and the MEMS transmitter/receiver 330 within the cylinder body 302. This data is transmitted back to a control computer (master computer) 95 for processing and interface with an operator at the initial launch pit 100. Optionally, a lubrication tube 313 maybe provided in the pipe 104*a*/104 (see FIG. 1A, as well as FIG. 1D). Lubrication in the form of water or a combination of lubricant and water can be provided through lubrication tube 313 to reduce the resistance on the inside and the outside of the pipe 104.

In at least one embodiment, two pairs of MFGE's 304 are provided, one pair in the center of the pipe 104 and one pair at the front of the pipe 104, within each pipe 104 including last pipe 104*a*). Optionally, more than two pairs of MFGE's could be provided. In at least one embodiment, a pair of communication and power bus bars 307 are provided within each pipe 104/104*a*. Alternatively only one bar 307 per pipe could be employed, or more than two bars 307, per pipe 104/104*a*. The communication and power bus bars 307 provide power to all elements within the CBDB 300 and all MFGE's 304 within the system of pipes 104. The MFGE's 304 in each pipe 104 also connect to the power and communication power bus bar 307 connection for each pipe; this provides power and communication connection between all pipes 104 and the CBDB 300. These arrangements are shown in the last pipe 104*a* as indicated in FIG. 2A, and these arrangements in all other pipes 104 can be the same. Additionally, the last pipe 104*a* includes differences, such as the fact that it contains the wireless receiver 332 and the special bus bar connector 309*a*. Information from the wireless receiver 332, within the last pipe 104*a*, is conveyed to the initial launch pit 100 by wire connection through the links of the pipes 104*a*/104 and communication and power bus bar 307.

Figure 6A:
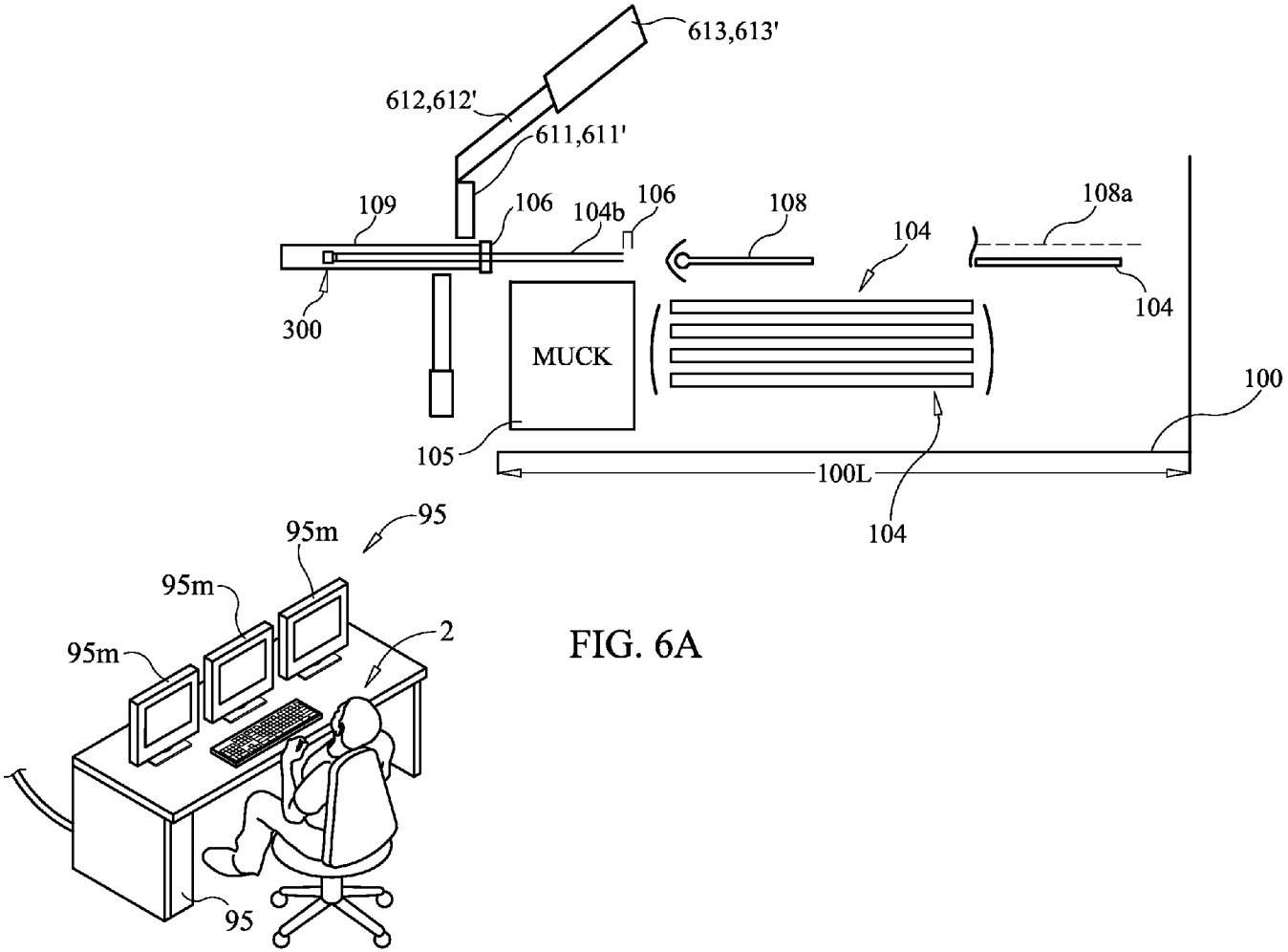
FIG. 6A illustrates an initial launch pit, launching the pipes and (CBDB) cylinder body/drill bit blade elements within the overall assembly in a horizontal method of launching the pipes according to an embodiment of the present invention.

The connection for each MFGE 304, at the end of each pipe 104 (normal pipe, not including the last pipe 104*a*) is completed when the pipes 104 are assembled at the initial launch site, as illustrated in FIG. 6A.

Figure 2B:
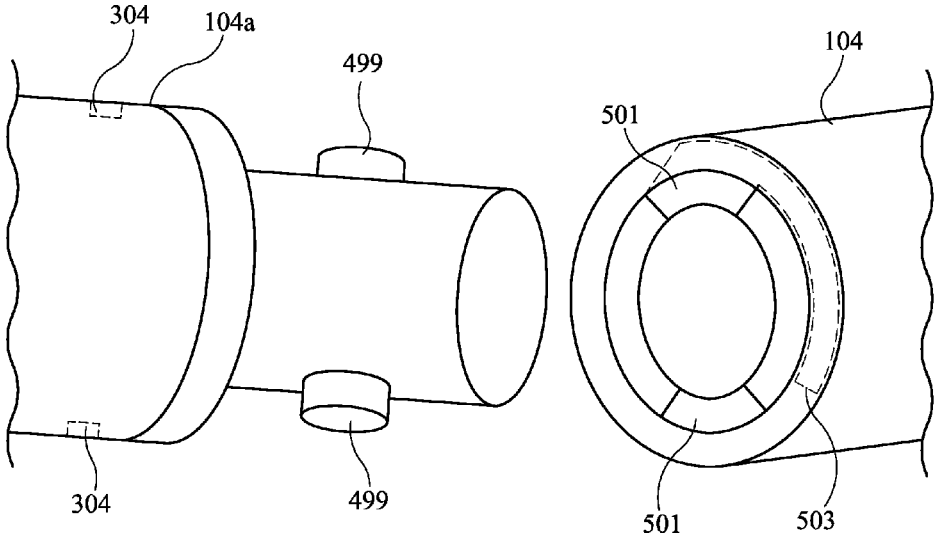
FIG. 2B is a partial view of a last pipe and next to last pipe illustrating a connection mechanism for connecting pipes according to an embodiment of the present invention.

FIG. 2B is a partial view of last pipe 104*a* and the next to last pipe 104 to be connected to it, which schematically illustrates a connection mechanism according to an embodiment of the present invention. Male connectors or tabs 499 extend radially outwardly from an end portion of pipe 104*a* that has a slightly smaller outside diameter than the remainder of the last pipe 104*a*. Mating slots 501 are provided in the end of the pipe 104 that is to be connected to pipe 104*a*. Mating slots 50-1 are configured and dimensioned to allow the male connectors 499 to slide therethrough with a close fit. Alternatively, the connectors could be reversed, with the mating connectors in the end of pipe 104*a* and the male connectors 499 on a smaller dimensional portion of pipe 104, as would be readily apparent to one of ordinary skill in the art. Once male connectors 499 are slid through mating connectors 501, they become aligned with a groove 503, at which time the pipes 104, 104*a* can be rotated relative to one another to rotate the male connectors 499 through the groove to make a connection like a bayonet connection. This rotation also rotates contacts of the bus bars 307 of each pipe into contact with one another to form an electrical connection therebetween, and aligns and other channels, such as optional lubrication channel 313, etc. Although the connectors 499, 501, 501 are illustrated for connection between pipe 104*a* and 104, the same types of connections can be provided for connections between pipes 104 and 104.

Figure 3A:
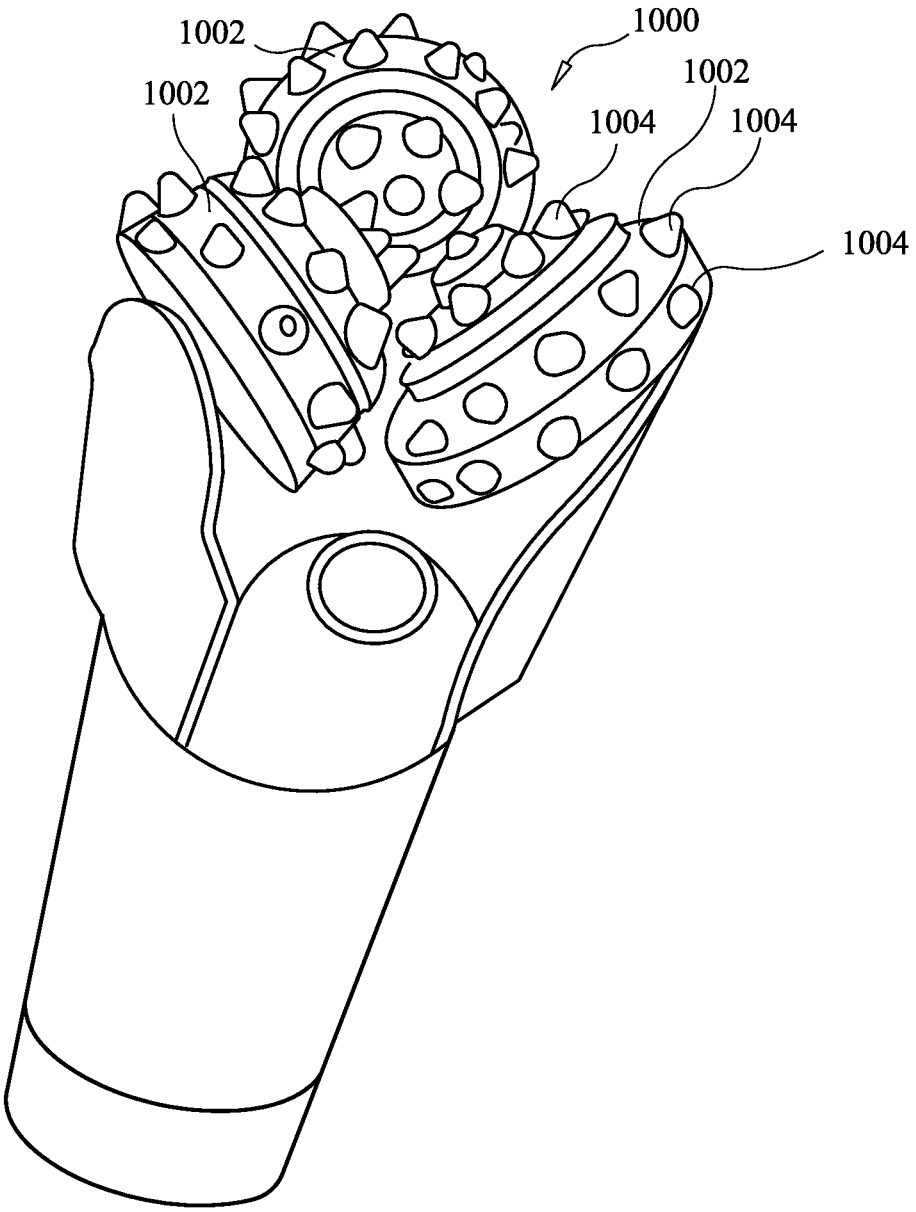
PRIOR ART FIG. 3A
FIG. 3A is an illustration of a conventional drill bit assembly with three drill blades each having three drill bit elements.
Figure 3B:
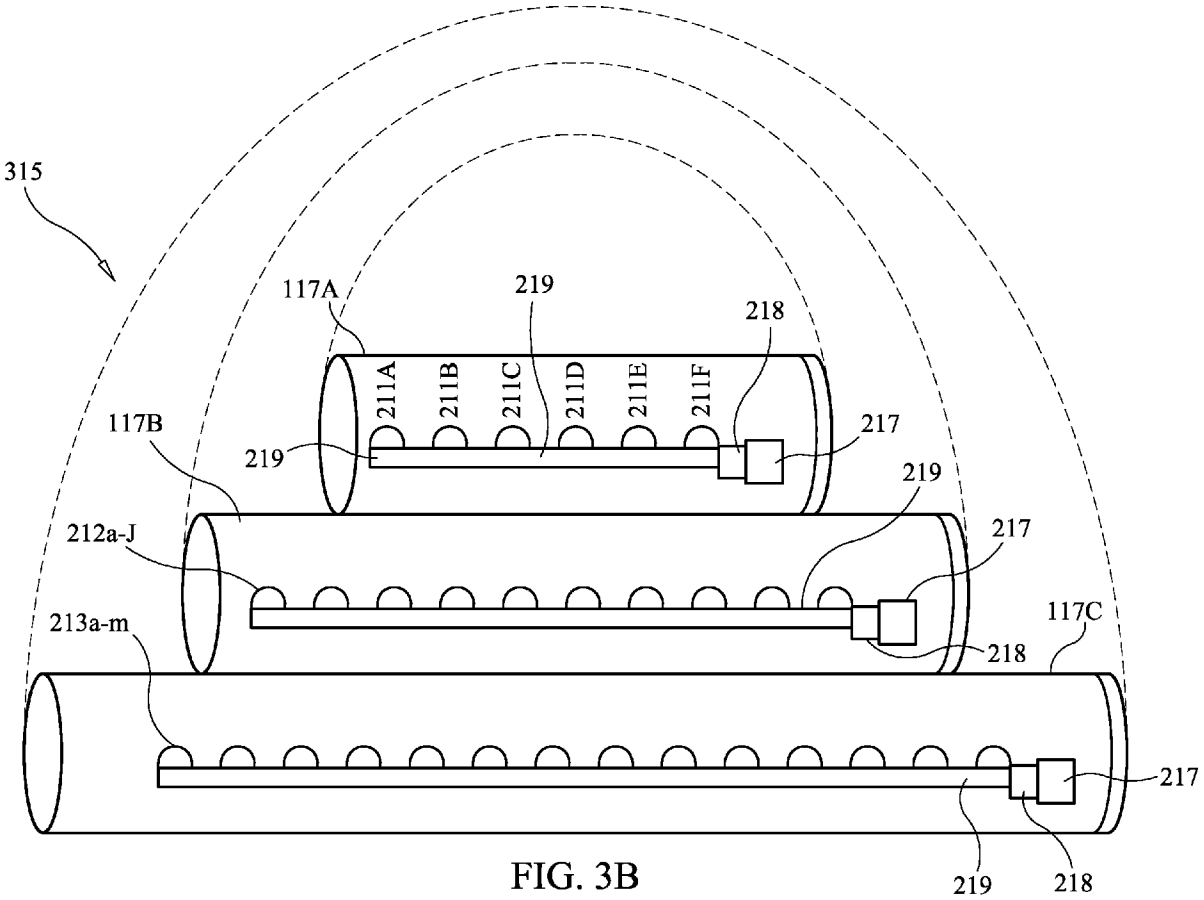
FIG. 3B schematically illustrates a drill bit blade having three drill bit blade elements according to an embodiment of the present invention.

FIG. 3A is an illustration of a conventional drill bit assembly 1000 with three drill bit elements 1002 each having three drill blades 1004 A more complex drill bit assembly may have more than three drill bit elements 1002 and/or more or fewer than three drill 1004 per drill bit element 1002.

FIG. 3B schematically illustrates a drill bit element 315 having three drill blades 117 (117A, 117B, 117C) that include MEMS cone transmitters 211, 212, 213, fabricated, along with other elements within the drill blades 117. "Micro-Electro-Mechanical Systems" (MEMS), involves the integration of mechanical elements, sensors, transducers, actuators, and electronics on a common silicon substrate through microfabrication technology. The MEMS cone transmitters transmit until they are worn down by a predetermined percentage of height (considered to be "desecrated", which can be down to 80%, 70%, 60% or some other predetermined percentage, as described previously), at which time that particular MEMS transmitter stops transmitting. When the signal from a MEMS transmitter is no longer being received, the computer 95 is programmed to alert the operator that the particular blade or element that the MEMS transmitter resides on needs to be changed. One set of the three drill bit blades 117 are indicated in FIG. 3B. The dotted lines indicate the blades 117A, 117B and 117C are rounded to form rings of a drill bit element 315 that is round (in cross-section), in a manner like that shown in the drill bit element 1002 shown in FIG. 3A.

MEMS cone transmitters 211*a-f*, 212*a-j*, and 213*a-m*, are hardwired by use of the cone data bus and power bar 219 to the MEMS wireless transmitter/receiver 218, within the drill bit blades 117 (117A, 117B and 117C, as shown in FIG. 3B). MEMS wireless transmitter/receiver 218 collects information regarding whether cone transmitters 211, 212, 213 are transmitting or not transmitting. When desecrated, the cone transmitters 211, 212, 213 within the drill bit blades 217A, 217B, 217C, respectively, stop transmitting. Larger drill bit blades may have more cone transmitters than smaller drill bit blades so that the spacing between cone transmitters can be the same on each blade, but this is not absolutely required. Thus, in the example shown in FIG. 3B, the number of cone transmitters 213 is greater than the number of cone transmitters 212, and the number of transmitters 212 is greater than the number of cone transmitters 211, as blade 117C is larger than blade 117B and blade 117B is larger than blade 117A.

The data transmitter/receiver 330, within the cylinder body 302, is in constant communication with the transmitters/receivers 218 which are in constant communication with the drill bit blade cone transmitters 211, 212, 213, providing wear information regarding the MEMS cone transmitters 211, 212, 213, so that this information is available to the master computer 95, at the initial launch pit 100 at all times. Each of the drill bit blade elements 117A, 117B and 117C also contains a link to a battery 217, used to power the MEMS cone transmitters 211, 212, 213 and data power bus bar 219. The battery 217 has a long useful life, but must be replaced or recharged periodically.

Figure 3C:
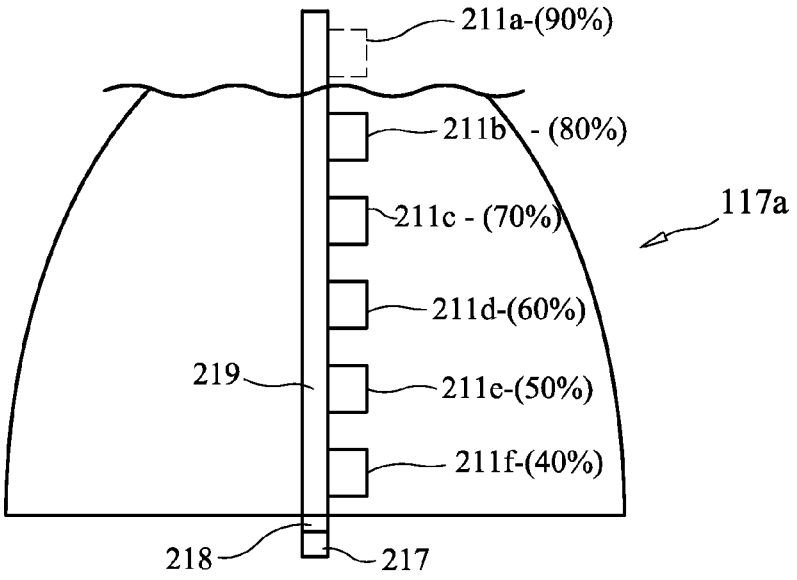
FIGS. 3C-3D are side views of a drill bit blade element according to an embodiment of the present invention.
Figure 3D:
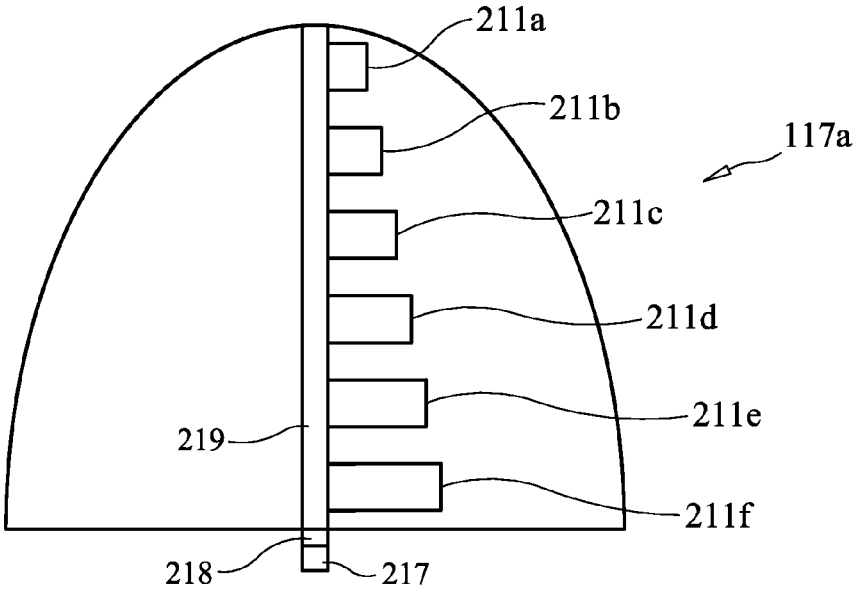

FIG. 3C indicates the smallest drill blade 117A from the embodiment of FIG. 3B, with six MEMS cone transmitters, indicated as 211*a-f*. The cone transmitters 211 and blade bus bar 219 typically extend in the axial direction of the cone as illustrated in FIGS. 3C-3D. Also indicated is the cone data bus and power bar (blade bus bar) 219, the wireless transmitter/receiver 218 and the drill bit blade battery 217. The wireless transmitter/receiver 218 transmits information to the MEMS transmitter/receiver 330, within the CBDB, indicating wear information characterizing the wear of the cone transmitters 211*a*-211*f*. When the drill bit blade MEMS cone transmitter 211*a* (indicated by dotted box) no longer transmits, this signifies that the drill bit blade 117A has worn out to this level (indicating 90% of the blade remaining).

FIG. 3D illustrates a fully functionally drill bit blade 117A with all cone transmitters 211*a*-211*f* working/transmitting properly.

Figure 4A:
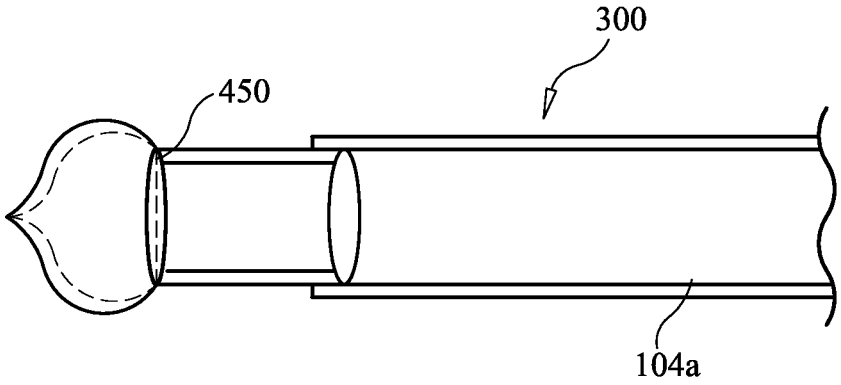
FIG. 4A schematically illustrates a CBDB in the drilling configuration, when the drill bit blades are rotating, according to an embodiment of the present invention.

FIG. 4A schematically illustrates the CBDB 300 in the normal, drilling position, i.e., when the drill bit blades are rotating and opening 450 is present. When the CBDB 300 is not operating in the normal drilling position, (i.e., when the drill bit blades are not rotating), the opening 450 closes and the pig configuration is assumed, as shown in FIG. 4B.

Figure 4B:
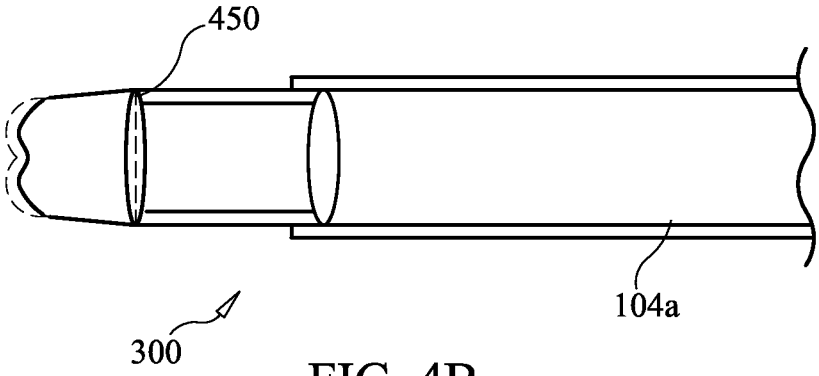
FIG. 4B schematically illustrates the CBDB when the drill bit blades are not rotating, and the pig configuration is assumed, according to an embodiment of the present invention.

The contracted drill bit blade position (pig configuration, wherein the drill bit is not rotating and the opening is closed) shown in FIG. 4B allows the drill bit assembly 301 to be small enough to be drawn back into the pipes and to be used as a clearing pig (with the opening 450 in the closed position). Use of the pig helps clear blockage within the pipes 104. The CBDB 300 can be returned to an intermediate pit 112 (see FIG. 5) or the initial launch pit 100 for drill bit replacement, repair or battery recharge as needed. In the pig configuration (FIG. 4B), the drill bit blade assembly 301 is not rotating, and the opening 450 is closed. This closed opening 450 arrangement allows the assembly to pull back and clear the muck towards the initial launch pit.

Figure 5:
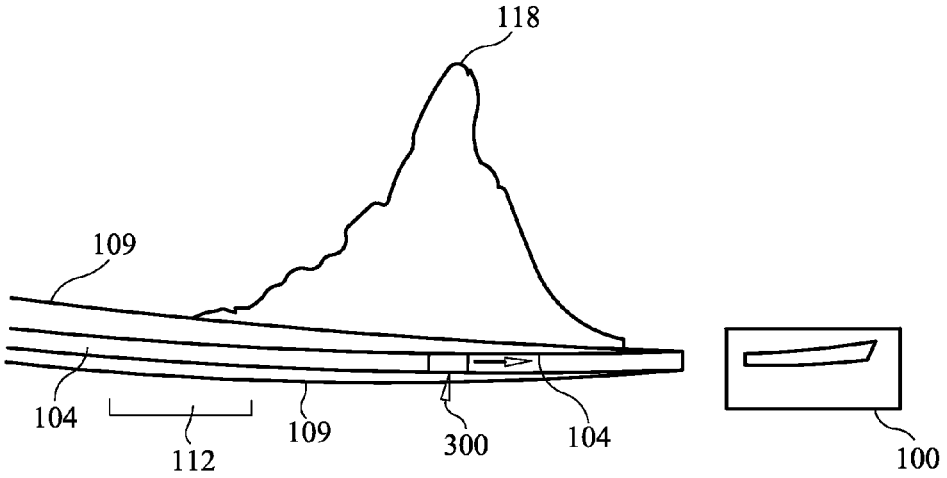
FIG. 5 illustrates the CBDB assembly transformed to a clearing pig, and used to aid in clearing a blockage in the pipes, according to an embodiment of the present invention.

FIG. 5 illustrates the CBDB 300 assembly transformed to a clearing pig, and used to aid in clearing a blockage in the pipes 104. The drill bit blade assembly is not rotating, the opening 450 is now closed. The pathway 109 is under a mountain 118 and is very inaccessible. The CBDB 300 is moving in the reverse direction towards the initial launch pit 100 by use of the (MFGE)'s 304/305 in the pipes, the (MFGE)'s are switched in magnetic polarity, thus, moving the CBDB 300 in the desired direction.

The CBDB 300 (which includes 301, 302 and 303) may be returned all of the way to the initial launch pit 100 if necessary to clear the blockage and/or replace the drill bit blade assembly 301. The CBDB 300 may be moved to an intermediate launch pit 112 for maintenance purposes if necessary. Because of the intermediate launch pit 112, the CBDB 300 does not have to be returned to the initial launch pit 100 for repair, if it can be repaired at the intermediate launch pit 112. Intermediate launch pit 112 would be located below ground level.

FIG. 6A illustrates an initial launch pit 100, launching the pipes 104 and CBDB 300, within the overall assembly in a horizontal method of launching the pipes 104 according to an embodiment of the present invention. The muck (returning material from the drilling operation) is indicated within the initial launch pit collection trench 105. The tube pusher 108 is also indicated. When the tube pusher 108 returns to its normal position (at rest), as shown at 108*a*, the muck is transferred through the pipes 104 and collected in the collection trench 105.

The length 100L of the initial launch pit 100 in one embodiment is approximately 200 feet. The pipes 104, in this example, are 100-150 feet long. In the case of drilling for oil, once the (CBDB) cylinder body/drill bit blade has reached the final position, the point of extracting oil, the oil reservoir connection 611 is switched to the first pipe 104*b*.

The oil reservoir connection 611 is then connected to the oil transport pipe 612, which in turn is connected to the oil reservoir 613. This allows the oil from the end point of drilling operation to be collected in the oil reservoir 613.

The method of drilling described above can also be used for drilling for natural gas or drilling for installing a fiber optic cable, water or sewer lines. In the case of a fiber optic cable line, water lines or sewer lines: the launch assembly apparatus would be mobile, with the ability to be moved out of the initial launch pit, allowing the permanent fiber optic cable line, water line or sewer line connection to be completed.

In the case of drilling for natural gas, a natural reservoir connection 611' is switched to the first pipe 104*b*. The natural gas reservoir connection is then connected to the natural gas pipe 612', which in turn is connected to the natural gas reservoir 613'.

FIG. 6A also illustrates the innovative machine's launch apparatus, the control panel 95 and operator 2 of the drilling operating system. In this example, the operator 2 is sitting at the system console 95, monitoring drilling operation. Some of the communications between the control panel and the other drilling system components may be wired, while others are wireless. The console 95 is connected to and in communication with all of the instruments within the three elements 301, 302 & 303 of the CBDB 300. The console 95 displays the position of the CBDB 300, temperature data, sonde data, gradiometer data, accelerometer data, etc. Communication occurs through the data bus bars within the pipes 104 from the launch pit 100 to the CBDB 300.

Figure 6B:
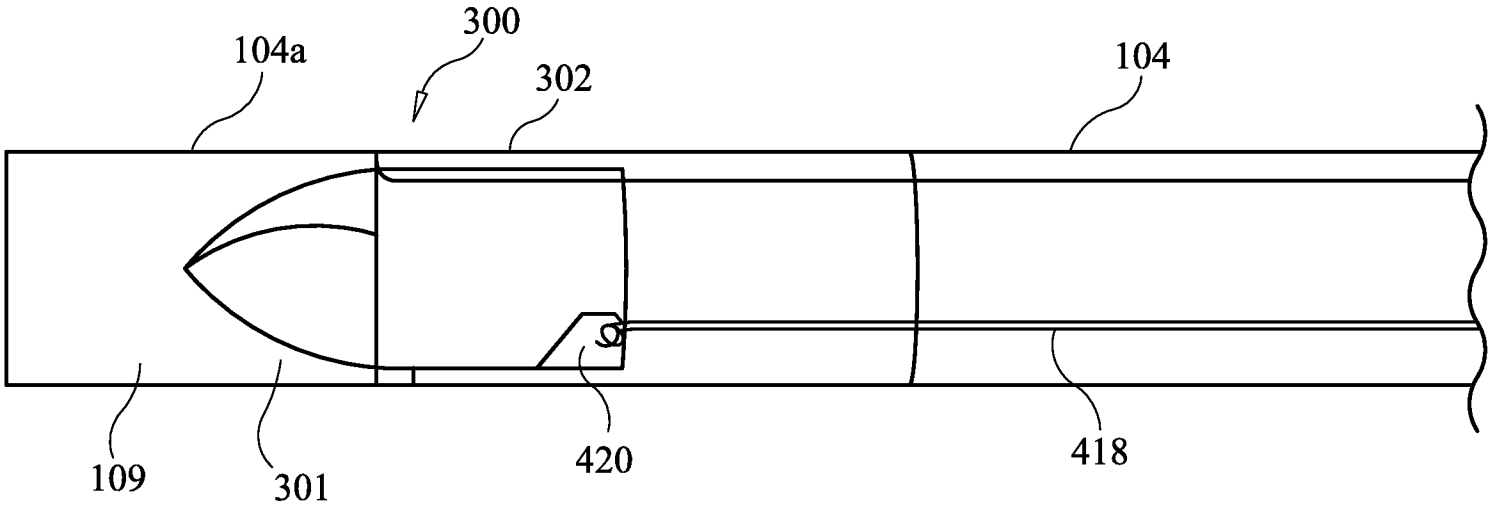
FIG. 6B illustrates a CBDB in a pig position, being used to draw a cable through a drill hole, according to an embodiment of the present invention.

In a case of installing a fiber optic cable or other cable, when the drilling operation is completed, the cable 418 is attached to the CBDB 300 via a hook, ring, or other attachment mechanism 420 provided in the CBDB 300 for releasably attaching the cable 418 thereto, see FIG. 6B. The CBDB 300 is in the pig position at this time, as shown, as no drilling is to be performed; rather, the CBDB 300 is used as a transport mechanism for drawing the cable 418 through the pathway 109 that has already been previously established by drilling. The cable 418 is thus moved by the same process of moving the CBDB 300 back and forth within the pipes.

The CBDB 300 is therefore equipped to pull/transport the fiber optic cable or other type of cable structure back and forth along the pathway 109. The transport device can be used to pull the fiber optic cable from intermediate launch site to another intermediate launch site or from the initial launch site to an intermediate launch site.

Figure 7:
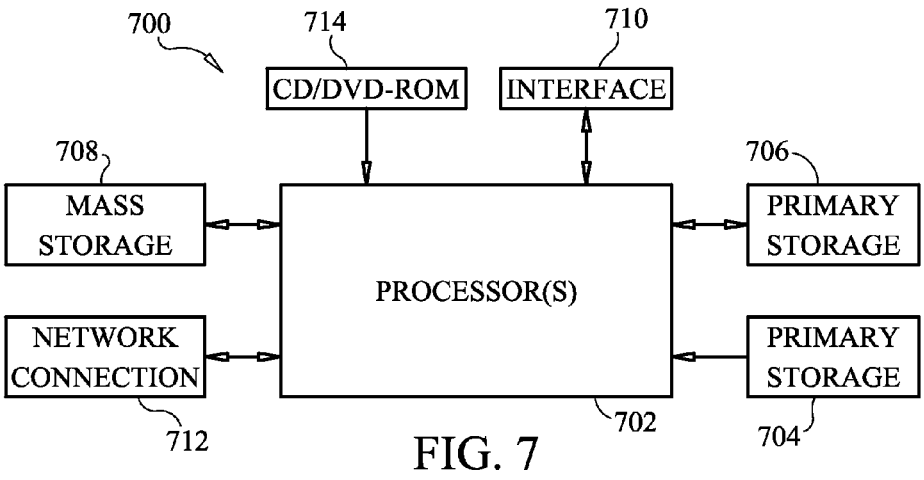
FIG. 7 illustrates a typical computer system, components of which, or all of which may be employed according to an embodiment of the present invention.

FIG. 7 illustrates a typical computer system, components of which, or all of which may be employed. The computer system 700 includes any number of processors 702 (also referred to as central processing units, or CPUs, and, for example, which may be employed in the computer controller of system, as well as one or more sub-sections described) that are coupled to storage devices including primary storage 706 (typically a random access memory, or RAM), primary storage 704 (typically a read only memory, or ROM). As is well known in the art, primary storage 704 acts to transfer data and instructions uni-directionally to the CPU and primary storage 706 is used typically to transfer data and instructions in a bi-directional manner. Both of these primary storage devices may include any suitable computer-readable media such as those described above. A mass storage device 708 is also coupled bi-directionally to CPU 702 and provides additional data storage capacity and may include any of the computer-readable media described above. Mass storage device 708 may be used to store programs, data and the like and is typically a secondary storage medium such as a hard disk that is slower than primary storage. It will be appreciated that the information retained within the mass storage device 708, may, in appropriate cases, be incorporated in standard fashion as part of primary storage 706 as virtual memory. A specific mass storage device such as a CD-ROM or DVD-ROM 714 may also pass data uni-directionally to the CPU.

CPU 702 is also coupled to an interface 710 that includes one or more input/output devices such as video monitors, track balls, mice, keyboards, microphones, touch-sensitive displays, transducer card readers, magnetic or paper tape readers, tablets, styluses, voice or handwriting recognizers, or other well-known input devices such as, of course, other computers, any of which may be included in console 95.

Finally, CPU 702 optionally may be coupled to a computer or telecommunications network using a network connection as shown generally at 712. With such a network connection, it is contemplated that the CPU might receive information from the network, or might output information to the network in the course of performing the above-described method steps. The above-described devices and materials will be familiar to those of skill in the computer hardware and software arts.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

That which is claimed is:

1. A cylinder body and drill bit assembly comprising:

a drill bit comprising a plurality of drill bit elements, each said drill bit element comprising at least one drill bit blade;

a cylinder body releasably connected to said drill bit;

a plurality of transmitters mounted on each said drill bit blade;

said cylinder body comprising a data transmitter and receiver in communication with said plurality of transmitters;

wherein said plurality of transmitters provide data characterizing a degree of wear of said drill bit; and wherein each of said plurality of transmitters is configured to transmit the data until worn down by a predetermined percentage, at which time transmission of the data ends.

2. The assembly of claim 1, wherein said data transmitter and receiver indicates transmissions from each of said plurality of transmitters when there is no wear on the drill bit, and wherein a percentage of the total number of said plurality of transmitters from which transmissions are no longer received after wear of the drill bit indicates a percentage of wear of the drill bit.

3. The assembly of claim 1, wherein said plurality of transmitters comprises a plurality of MEMS transmitters.

4. The assembly of claim 3, wherein said MEMS transmitters comprise MEMS cone transmitters.

5. The assembly of claim 1, wherein said data transmitter and receiver transmits data received from said plurality of transmitters to an external computer.

6. The assembly of claim 1, further comprising:

at least one instrument contained in said cylinder body and in electrical communication with an external computer, said at least one instrument comprising at least one sensor configured to monitor an environment in which drilling activities are occurring.

7. The assembly of claim 6, wherein said at least one sensor comprises at least one of a sonde or an accelerometer.

8. The assembly of claim 6, wherein said at least one sensor comprises a gradiometer.

9. The assembly of claim 6, wherein said at least one sensor comprises a pressure transducer.

10. The assembly of claim 6, wherein said at least one sensor comprises a chromatograph.

11. The assembly of claim 1, wherein said cylinder body comprises an attach/detach assembly for attaching to and detaching from a pipe.

12. The assembly of claim 11, wherein said attach/detach assembly comprises magnetic field generating elements.

13. The assembly of claim 1, further comprising magnetic field generating elements on said drill bit and cylinder body, configured to induce magnetic energy between one another to drive said drill bit in rotation relative to said cylinder body.

14. The assembly of claim 1, further comprising a cylinder body and drill bit assembly power bus bar and a bus bar connector configured to electrically connect said cylinder body and drill bit assembly power bus bar with a pipe power bus bar in a pipe.

15. The assembly of claim 1, wherein said drill bit comprises a central opening when said drill bit is rotating, and wherein said central opening is closed off when said drill bit is not rotating such that said drill bit can function as a pig.

16. A cylinder body and drill bit assembly comprising:

a drill bit comprising a plurality of drill bit elements, each said drill bit element comprising at least one drill bit blade;

a cylinder body connected to said drill bit, said cylinder body comprising an attach/detach assembly for attaching to and detaching from a pipe; and;

a plurality of transmitters mounted on each said drill bit blade;

said cylinder body comprising a data transmitter and receiver in communication with said plurality of transmitters;

wherein said plurality of transmitters provide data characterizing a degree of wear of said drill bit; and wherein said attach/detach assembly comprises magnetic field generating elements.

17. The assembly of claim 16, wherein said plurality of transmitters comprises a plurality of MEMS transmitters.

18. The assembly of claim 17, wherein said MEMS transmitters comprise MEMS cone transmitters.

19. A cylinder body and drill bit assembly comprising:

a drill bit comprising a plurality of drill bit elements, each said drill bit element comprising at least one drill bit blade;

a cylinder body releasably connected to said drill bit;

at least one transmitter mounted on at least one of said at least one drill bit blade;

said cylinder body comprising a data transmitter and receiver in communication with said at least one transmitter;

wherein said at least one transmitter is configured to transmit data characterizing a degree of wear of said drill bit; and wherein said at least one transmitter transmits the data until worn down by a predetermined percentage, at which time said at least one transmitter no longer transmits the data.

* * * * *